US007669528B2

(12) United States Patent
Dubuit et al.

(10) Patent No.: US 7,669,528 B2
(45) Date of Patent: Mar. 2, 2010

(54) SILKSCREEN PRINTER MACHINE AND APPARATUS

(75) Inventors: Jean-Louis Dubuit, Paris (FR); François Dumenil, Chaumes en Brie (FR)

(73) Assignee: Machines Dubuit, Noisy-le-Grand (FR)

( * ) Notice: Subject to any disclaimer, the term of this patent is extended or adjusted under 35 U.S.C. 154(b) by 471 days.

(21) Appl. No.: 11/447,152

(22) Filed: Jun. 6, 2006

(65) Prior Publication Data

US 2007/0022883 A1 Feb. 1, 2007

(30) Foreign Application Priority Data

Jun. 6, 2005 (FR) ..... 05 05731

(51) Int. Cl.
*B05C 17/06* (2006.01)

(52) U.S. Cl. ..... 101/126; 101/123

(58) Field of Classification Search ..... 101/115, 101/123, 124, 126, 129
See application file for complete search history.

(56) References Cited

U.S. PATENT DOCUMENTS 4,342,260 A 8/1982 Sala et al.
4,939,991 A 7/1990 Szarka
5,136,938 A * 8/1992 Pellegrina ..... 101/115
5,383,400 A * 1/1995 Szyszko ..... 101/126
5,988,059 A * 11/1999 Hamu ..... 101/114
6,012,387 A * 1/2000 Hoffman et al. ..... 101/115
6,053,101 A * 4/2000 Hix ..... 101/126
6,408,745 B1 * 6/2002 Topolewski et al. ..... 101/126
6,684,769 B2 * 2/2004 Hed ..... 101/129

* cited by examiner

*Primary Examiner*—Ren Yan
(74) *Attorney, Agent, or Firm*—Young & Thompson

(57) ABSTRACT

A silkscreen printer machine (8) includes:

a support structure (48); and at least one printing station (54) secured to the structure (48) and including at least one screen support (68) presenting a reception area adapted to receive a screen texture (70) having a pattern for printing placed thereon. The screen support (68) is carried by at least three support elements (78) secured to the structure (48), the support elements (78) not being in alignment and being positioned on either side of the reception area (69). The invention also provides associated printer apparatus.

14 Claims, 2 Drawing Sheets

SILKSCREEN PRINTER MACHINE AND APPARATUS

FIELD OF INVENTION

The present invention relates to a silkscreen printer machine comprising a support structure and at least one printing station secured to the structure and including at least one screen support presenting a reception area adapted to receive a screen texture having a pattern for printing placed thereon.

BACKGROUND OF THE INVENTION

As is known per se, articles are printed in a silkscreen printer machine in a printing station by pressing a wiper blade against a silkscreen texture, the texture being squeezed between the article and the blade.

While printing flat articles, such as compact disks, telephone cards, or solar cells, the articles for printing are placed on a turntable suitable for transferring them between various processing and printing stations.

In conventional manner, the printing station comprises a support structure, a screen support secured to the structure, and a blade-carrier carriage mounted on a support beam secured to the support structure and extending along a side face of the screen support.

The blade-carrier carriage is guided in translation on the support beam so as to enable the screen to be wiped by the blades. During the displacement of the blade-carrier carriage, the pattern for printing is pressed against the article by the blade pressing against the mesh of the screen and by said mesh coming into contact with the surface of the article for printing.

Such a printer machine is described in particular in patent document FR 2 666 050. In that document, the side face of the screen support is secured at two points to the support beam. The screen support is cantilevered out from the support structure over the turntable and thus over the article for printing.

Nevertheless, it has been found that the printing of the pattern on the article is not uniform. Such a printer machine therefore cannot be used for printing that requires printing of great precision, as is the case for printing solar cells where precision of one hundredth of a millimeter is required.

SUMMARY OF THE INVENTION

An object of the invention is to provide a printer machine of great precision.

To this end, the invention provides a printer machine of the above-specified type, characterized in that the screen support is carried by at least three support elements secured to the structure, said support elements not being in alignment and being positioned on either side of the reception area.

In particular embodiments, the printer machine includes one or more of the following characteristics:

- transport means for transporting at least one article for printing to bring it into register with the reception area, the transport means comprising at least one holding place for holding the article for printing;
- lift means for the support element secured to the support structure and suitable for causing the screen support to move towards and away from the holding place;
- the lift means comprise lift means common to all of the support elements;
- at least fifty percent of the reception area is inscribed in a polygon whose summits are positioned at the points of contact between the support elements and the screen support;

- the reception area is fully inscribed within said polygon;
- the transport means comprise a circular turntable provided with a central orifice, and one of the support elements passes through said central orifice;
- two support elements are positioned on a tangent to the turntable; and
- the machine includes at least one locating station comprising means for determining the thickness of the article for printing, and control means for controlling the lift means of the support elements as a function of the thickness determined for the article.

The invention also provides printer apparatus, characterized in that it comprises:

- a printer machine as mentioned above;
- at least one feed conveyor for feeding articles for printing, the conveyor having an unloading place for unloading articles for printing, and a storage place for storing articles for printing; and
- at least one first transfer device for transferring articles for printing, the transfer device comprising an arm hinged about a pivot axis positioned at equal distances from the unloading place and from the storage place.

In particular embodiments:

- the feed conveyor is positioned relative to the printer machine in such a manner that the hinged arm of the first transfer device is adapted firstly to turn through an angle of 120° between the loading place and the holding place, while also simultaneously causing the article to turn in a horizontal plane through an angle of 120°; and
- the apparatus comprises:
  - at least one removal conveyor for removing correctly-printed articles, said conveyor having a first loading place for receiving printed articles;
  - at least one removal conveyor for removing defective articles, said conveyor including a second loading place for receiving printed articles; and
  - at least one second transfer device for transferring printed articles, being positioned at equal distances from the first and second loading places and from the holding place; and
- the printer machine includes a checking station for checking articles after printing, and control means adapted to control the second transfer device so as to transfer the printed articles from the holding place to the first loading place or to the second loading place as a function of the state of each checked article.

BRIEF DESCRIPTION OF THE DRAWINGS

The invention can be better understood on reading the following description given purely by way of example and made with reference to the drawings, in which.

DETAILED DESCRIPTION OF THE INVENTION

Figure 1:
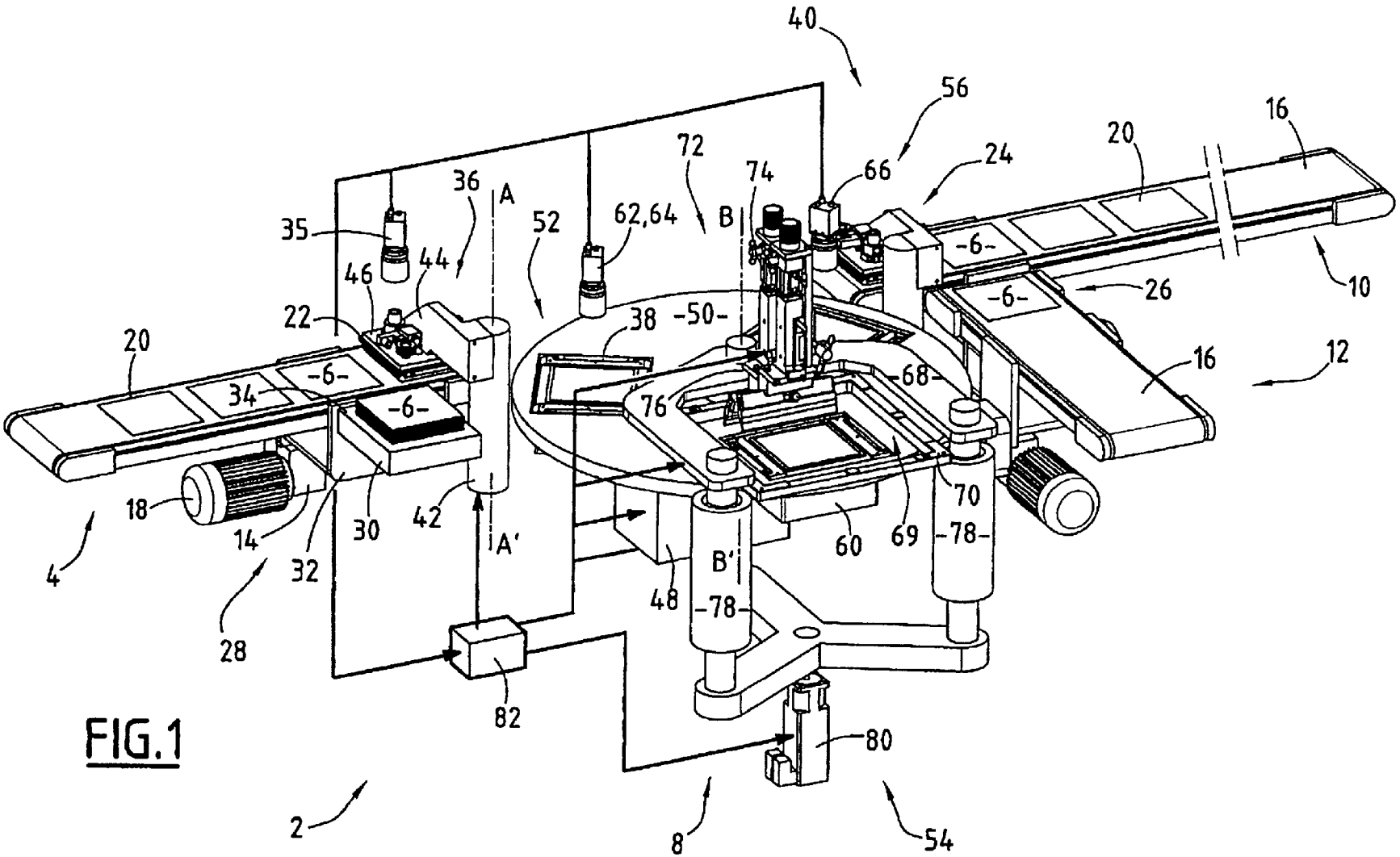
FIG. 1 is a perspective view of a first embodiment of printer apparatus of the invention.
Figure 2:
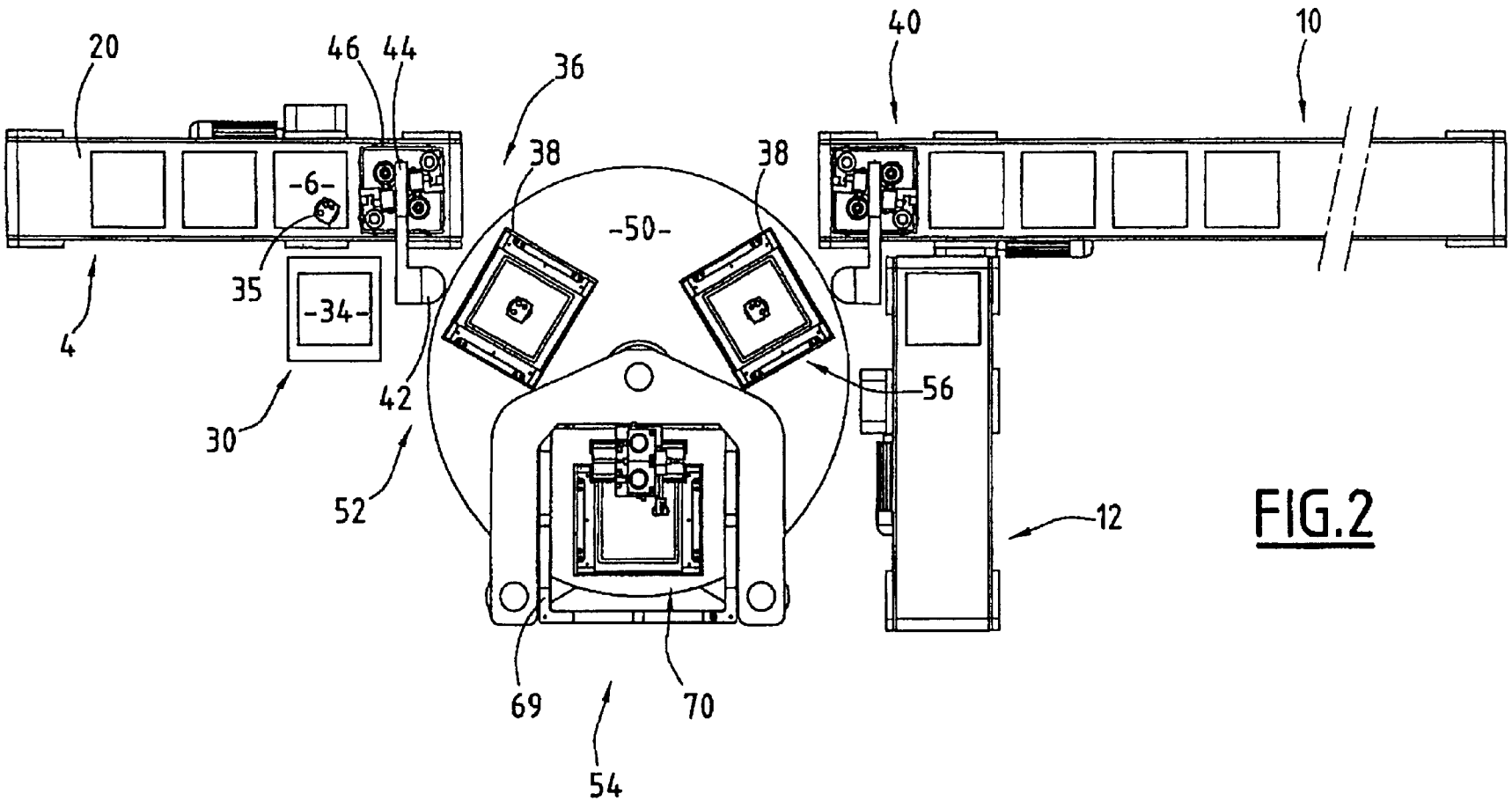
FIG. 2 is a plan view of the printer apparatus shown in FIG. 1.

The printer apparatus 2 of the invention is shown diagrammatically in FIGS. 1 and 2. It comprises a feed conveyor 4 for feeding articles 6 for printing, a printer machine 8, a removal-conveyor 10 for removing properly printed articles, and a removal conveyor 12 for removing articles that are badly printed or defective, and extending perpendicularly to the conveyor 10.

The feed and removal conveyors 4, 10, 12 are identical, each comprising a support structure 14 and a looped conveyor belt 16 held between two parallel deflection rollers, one of which is driven by a brushless motor 18.

Articles 6 for printing, such as solar cells, for example, are placed on the conveyor belt 16 one after another on support zones 20. The support zone 20 situated at the end of the feed conveyor 4 close to the printer machine 8 defines an unloading place 22 for unloading articles for printing. The support zones 20 situated at the ends of the removal conveyors 10 and 12 close to the printer machine 8 define first and second loading places 24 and 26 for loading printed articles.

A storage device 28 for storing articles 6 for printing is associated with the feed conveyor 4. It comprises a rectangular storage tray 30 and a support bracket 32 in the form of a square having one end secured to a side face of the tray 30 and its other end secured to the support structure 14.

The storage tray 30 is of a size that is slightly greater than the size of the articles 6 for printing and it presents a storage zone 34 on which said articles can be stacked while the printer machine 8 is not in operation, for example while the screen texture is being washed.

A monitor camera 35 for monitoring the existence of articles 6 for printing on the storage place 34 and on the conveyor belt 16 is located facing the conveyor 4. The operation of this camera is described below.

A feed transfer device 36 is interposed between the feed conveyor 4 and the printer machine 8. It is suitable for moving articles 6 between the unloading place 22 and an article-holding place 38 that is situated on the printer machine 8. It is also suitable for turning the article round on himself through an angle of 120°.

An opposite movement is performed by a removal transfer device 40 interposed between the printer machine 8 and the removal conveyors 10 and 12, in order to transport printed articles 6 on the removal conveyors 10, 12 after printing.

The feed and removal transfer devices 36 and 40 are identical. Each comprises a cylindrical stand 42 extending along a vertical axis A-A', provided with an arm 44 that is articulated about the axis A-A' and that projects away therefrom and perpendicularly thereto. A gripper element 46 for gripping articles is secured to the free end of the arm 44. It comprises a body in the form of a rectangular block having a suction device mounted thereon that enables articles to be lifted and held.

The transfer devices 36 and 40 include means (not shown) for driving the stand in an axial direction relative to the axis A-A' and means (not shown) for driving the arm 44 to turn around the axis A-A'.

As can be seen in FIG. 2, the stand 42 of the feed transfer device 36 is positioned at equal distances from the unloading place 22, the storage place 34, and the holding place 38, such that when the arm 44 turns around the axis A-A', the gripper element 46 is adapted to take articles 6 for printing from the unloading place 22 or the storage place 34, and to lay said articles on the storage place 34 or the holding place 38.

Similarly, the stand 42 of the removal transfer device 40 is positioned at equal distances from another retaining place 38 of the printer machine and from the loading places 24 and 26 of each of the removal conveyors.

The printer machine 8 comprises a support structure 48 supporting a turntable 50 in the form of a disk, means (not shown) for sequentially driving the turntable about its central axis B-B' relative to the support structure, and three processing stations 52, 54, and 56 disposed at the periphery of the turntable 50.

The turntable 50 moves the articles 6 from one processing station to another. It carries three holding places 38 for holding articles for printing that are disposed on the top face of the turntable 50, on which the articles 6 are placed, and under which suction units 60 are mounted to hold the articles 6 in place.

The holding places 38 are rectangular or square in shape and they are situated on the turntable 50 in such a manner that two of their sides are parallel to a tangent to the turntable. They are regularly spaced apart angularly, such that they are at angles of 120° relative to one another.

The processing stations 52, 54, and 56 disposed at the periphery of the turntable 50 in register with each holding place 38 comprise, positioned side by side and at equal distances from one another: a locating station 52 for locating the zone for printing on an article 6; a printing station 54; and a checking station 56 for checking the zone printed on the article 6.

The locating station 52 comprises a locating camera 62 suitable for viewing the article 6 for printing and a sensor 64 for measuring its thickness, e.g. an infrared sensor or a laser sensor. The camera 62 and the sensor 64 are situated close to the feed conveyor 4 and facing the holding place 38 when the turntable 50 is stationary.

The checking station 56 for checking the article 6 for printing comprises a checking camera 66 suitable for viewing the article 6 after printing. The camera 66 is situated close to the removal conveyors 10 and 12, and facing a holding place 38 when the turntable 50 is stationary.

The printing station 54 comprises a screen support 68 having an area 69 for receiving a screen texture 70 and a blade and backing blade system 72 suitable for pressing against the mesh of the screen to apply the pattern for printing on the article.

The blade and backing blade system 72 comprises two blades suitable for moving vertically under drive from an actuator 74, and a carriage 76 carrying the blades and the actuator. The carriage 76 is guided on a support beam (not shown) secured to two opposite sides of the screen support 68.

The screen support 68 extends over the turntable 50. It is supported on three pillars 78 that ensure stability. These pillars 78 form support elements for the screen support 68. They are positioned in non- aligned manner on either side of two opposite sides of the reception area 69.

The reception area 69 is defined by means for securing the screen texture 70 to the screen support 68. In order to ensure that the screen texture 70 is stable, the reception area 69 is inscribed within a triangle whose summits are situated at the three points of contact of the pillars 78 to the screen support 68. This triangle is defined in a horizontal plane.

In particular, two of the pillars 78 of the screen support 68 are positioned on a tangent to the turntable 50, while the other pillar 78 lies on the axis of the turntable 50.

In the embodiment of the invention shown in the figures, one of the pillars 78 lies on the axis of rotation B-B' of the turntable 50, however it is also possible for this pillar 78 to be positioned away from said axis, along the rim of the screen support 68.

Thus, two opposite sides of the screen support 68 are held securely, unmoving, and stable so that when the blades press the mesh of the screen texture 70 against the article 6 for printing, the distance between the mesh and the article 6 is constant along the entire length of the mesh over which the blades pass.

The pillars 78 are suitable for being moved vertically in order to adjust the distance between the screen texture 70 and the article 6 for printing as a function of the height of the article 6 as determined by the sensor 64.

For this purpose, the pillars 78 are mounted to slide lengthwise perpendicularly to the plane of the support screen 68 on an actuator 80. This actuator constitutes common lift means adapted to raise and lower all three pillars 78 simultaneously.

Thus, it is possible to adjust the distance between the screen texture 70 and the article 6 for printing in a manner that is precise so as to improve the quality of printing and avoid breaking an article that is fragile.

The screen support 68 is mounted to move relative to the pillars 78 in order to position the screen texture 70 exactly in register with the article 6 for printing. In particular, the screen support 68 is mounted to move radially and tangentially relative to the turntable 50 and can turn around the center of gravity defined by the positions in a horizontal plane of the three points where the pillars 78 are secured to the screen support 68.

The printing station 54 further comprises means that are not shown for moving the screen support 68 in radial and tangential translation and in rotation.

The monitor camera 35, the locating camera 62, the checking camera 66, the two transfer devices 36 and 40, the drive means for the turntable 50, the blade and backing blade system 72, and the means for moving the screen support 68 are connected to a unit 82 for controlling and synchronizing the printer apparatus.

This control unit 82 is adapted to control the printer apparatus 2 as a whole so as to transfer and print articles 6 in series. In particular, it is suitable for controlling the pivot angle of the arm 44 of the feed transfer device 36 as a function of the operating state of the printing station 54 and as a function of the presence of articles 6 for printing on the feed conveyor 4 or on the storage device 38, where said presence is determined as a function of images delivered by the monitor camera 35.

The control unit 82 is suitable for calculating the position to be taken by the screen support 68 so that the pattern is applied accurately on the article, on the basis of the image received by the locating camera 62 and as a function of the thickness of the article for printing as measured by the sensor 64.

For this purpose, the control unit 82 is adapted to compare the image viewed by the locating camera 62 with a prerecorded image where the desired printing zone is defined relative to the shape of the article or relative to previously-printed patterns, and to control the displacement of the screen support 68 as a function of the result of said comparison.

The control unit 82 is also suitable for controlling the angle of rotation of the arm 44 of the removal transfer device 38 as a function of the image viewed by the checking camera 66 is order to position properly-printed articles on the loading place 24 of the conveyor 10, and poorly-printed articles on the loading place 22 of the conveyor 12.

For this purpose, the control unit 82 compares the image viewed by the checking camera 66 with the prerecorded image used for determining the displacement of the support screen 68.

Initially, the feed conveyor 4 transports the articles 6 for printing on the conveyor belt 16 to the unloading place 22.

If the printing station 54 is in a normal operating state, the control unit 82 causes the feed transfer device 36 to transport the articles 6 for printing situated at the unloading place 22 to the holding place 38.

For this purpose, the stand 42 of the transfer device 36 moves down and the gripper element 46 picks up the article 6 for printing by suction. Thereafter the stand 42 rises and turns through an angle of 120° about the axis A-A'.

Thereafter, the stand 42 moves down to the height of the turntable 50. The article 6 for printing is laid on the holding place 38 of the turntable by turning of the suction device.

When the printing station 54 is in a non-functional state, for example while the screen texture 70 is being washed, the stand 42 turns through an angle of 90° and the article 6 for printing is unloaded onto the storage place 34.

When the monitor camera 35 detects that there are no articles for printing on the feed conveyor 4, it sends this information to the control unit 82, which then controls the feed transfer device 36 so that it loads articles 6 for printing from the storage place 34 onto the holding place 38.

At the locating station 52, the camera 62 views the article for printing and transmits the viewed image to the control unit 82 which uses this image to determine the exact position of the article for printing, together with its shape, the center of the article, or an earlier printing thereon.

In parallel, the sensor 64 determines the thickness of the article 6 for printing and transmits this information to the control unit 82.

The turntable 50 begins by turning through an angle of 120° so that the article for printing comes into register with the screen texture 70 of the printing station.

The control unit 82 calculates the position to be taken up by the screen support 62 relative to the holding place 38 to ensure that the pattern printed through the screen texture 70 is correctly positioned on the article 6 for printing.

Thereafter, the control unit 82 causes the actuator 80 to lift the screen support 68 as a function of the thickness of the article 6 for printing as measured at the locating station 52.

The control unit 82 then causes the radial, tangential, and rotational displacement means of the screen support 68 to position the screen texture 70 in register with the zone for printing on the article as defined by the unit 82 from the image viewed by the camera 62 and from a prerecorded image.

Once the turntable has finished turning through 120°, and the article is in register with the screen texture, the control unit 82 causes the actuator 74 to press the blades against the mesh of the texture 70 and also causes the blade-carrier carriage drive means to operate so that the blades move right across the screen texture 70.

After the blades have been raised, the control unit 82 causes the turntable 50 to turn through an angle of 120° so that the article 6 for printing is transferred to the checking station 56.

In this station, the camera 66 views the zones printed on the article and transmits the resulting image to the control unit 82 which compares said image with the predefined image defining the exact position for the pattern that is to be printed on the article.

When the article 6 has been printed correctly, the control unit 82 controls the removal transfer device 38 so that it turns through an angle of 120° in order to position the printed article 6 on the first loading place 24 of the removal conveyor 10.

When the article has been badly printed, i.e. when the printing it not sufficiently precise or when the article has broken during printing, the control unit 82 causes the removal transfer device to pivot through an angle of 90° so as to bring the printed article onto the second loading place 26 belonging to the removal conveyor 12 for taking away reject printed articles.

The invention claimed is:

1. A silkscreen printer machine comprising:

a support structure;

at least one printing station secured to the structure and comprising at least one screen support presenting a reception area suitable for receiving a screen texture on which there is a pattern for printing, the screen support being carried by at least three support elements secured to the structure, said support elements being non-aligned and being positioned on either side of the reception area; and transport means for transporting at least one article for printing to bring it into register with the reception area;

wherein the transport means comprise a circular turntable having a central orifice, and wherein said three support elements extend along axes parallel to each other, one of said three support elements passes through said central orifice.

2. The printer machine according to claim 1, wherein the transport means comprise at least one holding place for holding the article for printing; and wherein the printer machine includes lift means for raising the support elements that are secured to structure and suitable for moving the screen support towards and away from the holding place.

3. The printer machine according to claim 2, wherein the lift means comprise lift means common to all of the support elements.

4. A The printer machine according to claim 3, wherein at least fifty percent of the reception area is inscribed in a polygon whose summits are positioned at the points of contact between the support elements and the screen support.

5. The printer machine according to claim 1, wherein at least fifty percent of the reception area is inscribed in a polygon whose summits are positioned at the points of contact between the support elements and the screen support.

6. The printer machine according to claim 5, wherein the reception area is fully inscribed within said polygon.

7. The printer machine according to claim 1, wherein two support elements are positioned on a tangent to the turntable.

8. The printer machine according to claim 2, further comprising at least one locating station comprising means for determining the thickness of the article for printing, and control means for controlling the lift means of the support elements as a function of the thickness determined for the article.

9. The printer machine according to claim 2, wherein the support elements comprise pillars mounted slidably lengthwise perpendicularly to the plane of the support screen on the lift means that are common to the three pillars for raising them and lowering them simultaneously.

10. The printer machine according to claim 2, wherein at least fifty percent of the reception area is inscribed in a polygon whose summits are positioned at the points of contact between the support elements and the screen support.

11. A printer apparatus, comprising:

a printer machine comprising a support structure; at least one printing station secured to the structure and comprising at least one screen support presenting a reception area suitable for receiving a screen texture on which there is a pattern for printing, the screen support being carried by at least three support elements secured to the structure, said support elements being non-aligned and being positioned on either side of the reception area; and transport means for transporting at least one article for printing to bring it into register with the reception area;

wherein the transport means comprise a circular turntable having a central orifice, and wherein said three support elements extend along axes parallel to each other, one of said three support elements passes through said central orifice;

at least one feed conveyor for feeding articles for printing, the conveyor having an unloading place for unloading articles for printing, and a storage place for storing articles for printing; and at least one first transfer device for transferring articles for printing, the transfer device comprising an arm hinged about a pivot axis positioned at equal distances from the unloading place and from the storage place.

12. The printer apparatus according to claim 11, wherein the feed conveyor is positioned relative to the printer machine in such a manner that the hinged arm of the first transfer device is adapted firstly to turn through an angle of 120° between the unloading place and the holding place, while also simultaneously causing the article to turn in a horizontal plane through an angle of 120°.

13. The printer apparatus according to claim 11, further comprising:

at least one first removal conveyor for removing correctly-printed articles, said first removal conveyor having a first loading place for receiving printed articles;

at least one second removal conveyor for removing defective articles, said second removal conveyor including a second loading place for receiving printed articles; and at least one second transfer device for transferring printed articles, being positioned at equal distances from the first and second loading places and from the holding place;

and wherein the printer machine includes a checking station for checking articles after printing, and control means adapted to control the second transfer device so as to transfer the printed articles from the holding place to the first loading place or to the second loading place as a function of the state of each checked article.

14. The printer apparatus according to claim 12, further comprising:

at least one first removal conveyor for removing correctly-printed articles, said first removal conveyor having a first loading place for receiving printed articles;

at least one second removal conveyor for removing defective articles, said second removal conveyor including a second loading place for receiving printed articles; and at least one second transfer device for transferring printed articles, being positioned at equal distances from the first and second loading places and from the holding place;

and wherein the printer machine includes a checking station for checking articles after printing, and control means adapted to control the second transfer device so as to transfer the printed articles from the holding place to the first loading place or to the second loading place as a function of the state of each checked article.

* * * * *